US010697476B2

(12) United States Patent
Wirtl et al.

(10) Patent No.: US 10,697,476 B2
(45) Date of Patent: Jun. 30, 2020

(54) ACTUATOR CONTROLLER AND METHOD FOR REGULATING THE MOVEMENT OF AN ACTUATOR

(71) Applicant: Festo AG & Co. KG, Esslingen (DE)

(72) Inventors: Hannes Wirtl, Schongau (DE); Martin Maichl, Salach (DE)

(73) Assignee: FESTO SE & Co. KG, Esslingen (DE)

( * ) Notice: Subject to any disclaimer, the term of this patent is extended or adjusted under 35 U.S.C. 154(b) by 213 days.

(21) Appl. No.: 15/503,596

(22) PCT Filed: Aug. 14, 2014

(86) PCT No.: PCT/EP2014/002238

§ 371 (c)(1),
(2) Date: Feb. 13, 2017

(87) PCT Pub. No.: WO2016/023569

PCT Pub. Date: Feb. 18, 2016

(65) Prior Publication Data

US 2017/0234333 A1 Aug. 17, 2017

(51) Int. Cl.

*F15B 11/00* (2006.01)
*F15B 11/04* (2006.01)
*F15B 11/10* (2006.01)

(52) U.S. Cl.

CPC ..... *F15B 11/006* (2013.01); *F15B 11/04* (2013.01); *F15B 11/10* (2013.01); *F15B 2211/30575* (2013.01); *F15B 2211/327* (2013.01); *F15B 2211/351* (2013.01); *F15B 2211/353* (2013.01); *F15B 2211/426* (2013.01); *F15B 2211/455* (2013.01); *F15B 2211/46* (2013.01); *F15B 2211/6309* (2013.01);

(Continued)

(58) Field of Classification Search

CPC ..... F15B 2211/636; F15B 2211/6326; F15B 2211/6654

See application file for complete search history.

(56) References Cited

U.S. PATENT DOCUMENTS 4,031,813 A * 6/1977 Walters ..... F15B 11/02 137/625.64
4,205,592 A * 6/1980 Haussler ..... F15B 21/08 137/486

(Continued)

FOREIGN PATENT DOCUMENTS

DE 102008028189 2/2010
WO WO2013115986 8/2013

*Primary Examiner* — Frank Daniel Lopez
(74) *Attorney, Agent, or Firm* — Hoffmann & Baron, LLP

(57) ABSTRACT

An actuator controller for actuating an actuator which can be operated fluidically, having a feed line for an inflow of the working fluid to an actuator connector and having a discharge line for an outflow of the working fluid to a fluid outlet, wherein the feed line is assigned a feed line valve and the discharge line is assigned a discharge valve, which valves are configured in each case to influence a volumetric fluid flow at the actuator connector, and having a control device for actuation of the feed line valve and the discharge valve. A throughflow sensor is arranged in a line section between the discharge valve and the fluid outlet, which throughflow sensor is configured for determining a volumetric fluid flow in the discharge line and for providing a throughflow signal.

2 Claims, 2 Drawing Sheets

(52) U.S. Cl.
CPC ..... *F15B 2211/6326* (2013.01); *F15B 2211/6654* (2013.01); *F15B 2211/7053* (2013.01); *F15B 2211/75* (2013.01); *F15B 2211/755* (2013.01); *F15B 2211/8855* (2013.01)

(56) References Cited

U.S. PATENT DOCUMENTS 4,548,296 A * 10/1985 Hasegawa ..... B66F 9/22 137/486
4,763,560 A * 8/1988 Sasaki ..... F15B 11/006 91/361
4,932,502 A * 6/1990 Blain ..... B66B 1/24 187/286
6,848,323 B2 * 2/2005 Krouth ..... F15B 15/2838 73/861.47
2002/0162327 A1 11/2002 Stephenson et al.
2009/0145120 A1 * 6/2009 Esders ..... F15B 11/161 60/422

* cited by examiner

ACTUATOR CONTROLLER AND METHOD FOR REGULATING THE MOVEMENT OF AN ACTUATOR

This application claims priority based on an International Application filed under the Patent Cooperation Treaty, PCT/EP2014/002238, filed Aug. 14, 2014.

BACKGROUND OF THE INVENTION

The invention relates to an actuator controller for activating a fluidically operable actuator, the controller comprising a feed line for an inflow of a working fluid from a fluid port to an actuator port and a discharge line for an outflow of the working fluid from the working port to a fluid outlet, wherein the feed line is assigned a feed line valve and the discharge line is assigned a discharge line valve, each of which is designed to influence a fluid flow rate at the actuator port, and the controller further comprising a control device for an activation of the feed line valve and the discharge line valve. The invention further relates to a method for controlling the movement of an actuator.

From DE 10 2008 028 189 A1, an electropneumatic valve for the activation of pneumatic actuators to operate fittings in systems of automation technology is known. The valve comprises at least one electropneumatic transducer and a pneumatic amplifier, the pneumatic amplifier comprising at least one valve device for the optional connection of a connecting passage leading to the actuator to either a feed passage or a discharge passage, the valve device being actuated via the electropneumatic transducer by way of an electric actuating signal. In this, it is provided that at least one flow sensor the output signal of which is fed back to the electric actuating signal is incorporated into the connecting passage to the actuator.

SUMMARY OF THE INVENTION

The invention is based on the problem of providing an actuator controller and a method for controlling the movement of an actuator, in which a simple structure is ensured for the actuator controller and a reliable function is ensured for the movement control.

According to a first aspect of the invention, this problem is solved with the following features: Actuator controller for activating a fluidically operable actuator, the controller comprising a feed line for an inflow of a working fluid from a fluid port to an actuator port and a discharge line for an outflow of the working fluid from the actuator port to a fluid outlet, wherein the feed line is assigned a feed line valve and the discharge line is assigned a discharge line valve, each of which is designed to influence a fluid flow rate at the actuator port, and the controller further comprising a control device for an activation of the feed line valve and the discharge line valve, wherein a flow sensor, which is designed to determine a fluid flow rate in the discharge line and to provide a flow signal, is coupled to the control device in order to facilitate a movement control (closed loop control) for an actuator movement in a manner which is dependent on the flow signal, is placed in a line section between the discharge line valve and the fluid outlet.

Owing to the installation of the flow sensor between the discharge line valve and the fluid outlet, an average pressure of the working fluid flowing through the flow sensor is at a lower level than if the flow sensor were installed into the feed line, where the supply pressure for the pressurised working fluid is applied. This is due to the fact that the working fluid has already transferred a part of its energy to the connected actuator. Furthermore, at the fluid outlet the working fluid is discharged either into the environment or into a non-pressurised storage tank, so that pressure losses for the working fluid after passing through the flow sensor can be considered to be negligible. The pressure level is further reduced in the line section where the flow sensor is located by flow losses for the working fluid as it is discharged from the actuator and by a targeted restriction in the discharge line by a suitable activation of the discharge line valve. As a result of this low pressure level, the flow sensor can be constructed in a simpler way than if it were installed into the feed line, where a higher pressure level prevails. As a result of the arrangement of the flow sensor according to the invention, a low-cost design of the flow sensor can advantageously be combined with a high measurement accuracy for the flow sensor.

Typical methods for flow detection include ultrasonic flow measurement, differential pressure methods at a presettable orifice measuring section or electromechanical flow measurement. By way of example, it is provided that the flow sensor provides an electric flow signal, in particular a variable voltage or current level, which is transferred to the control device and has a presettable relationship to the actual current working fluid flow through the flow sensor. Using the flow signal, the control device can draw a conclusion on how the actuator, which may for example be a piston of a pneumatic or hydraulic cylinder assembly, moves. Knowing the speed of movement for the actuator, the control device can effect a movement control for the actuator movement which is dependent on the flow signal by influencing the inflow of working fluid into the actuator and/or the outflow of working fluid from the actuator, or by other measures, such as the activation of a braking device for the actuator.

Advantageous further developments of the invention are the subject matter of the dependent claims.

It is expedient if the control device is designed to perform the movement control for an activation of the discharge line valve and/or the feed line valve in a manner which is dependent on the flow signal. The movement control for the actuator movement may in particular be a speed control performed with the aid of the control device in a manner which is dependent on the flow signal detected in the discharge line. For influencing the movement of the actuator for the performance of movement control, it can be provided that the working fluid flowing out from the actuator is influenced by the suitable activation of the discharge line valve. Such a movement control is suitable both for single-acting and for double-acting actuators, in particular for fluidic working cylinders. In a single-acting actuator, a working chamber of variable size is simply filled with a suitable quantity of working fluid in a manner dependent on the target position of the actuator. To such an actuator, an internal or external load can be applied, for example, such as an external weight or the force of a return spring. A movement control with the actuator controller according to the invention can, for example, be provided for a retraction movement of the actuator, in which the working chamber of the actuator is reduced in size by the externally applied weight or by the action of the return spring. In this process, the working fluid received in the actuator flows into the discharge line after passing through the actuator port and leaves the fluidic system at the fluid outlet after passing through the discharge line valve and the flow sensor. In this operating mode, the position of the discharge line valve can be influenced using the flow signal of the flow sensor in order to obtain a presettable movement profile for the movement of the actuator. In addition or as an alternative to the activation of the discharge line valve, an external braking device can be activated for movement control using the flow signal.

In a double-acting actuator having two working chambers of variable size, which are separated from one another by a movable piston, it may for example be provided that each working chamber has its own actuator controller, wherein that actuator controller which is connected to the decreasing operating chamber of the double-acting actuator during a movement of the actuator performs the flow measurement in the discharge line and controls the actuator movement using the detected flow signal, where applicable while exchanging information with the respective other actuator controller responsible for providing the pressurised working fluid to the increasing working chamber.

It is advantageous if the feed line valve and/or the discharge line valve is/are designed as a proportional valve, in particular for an electric activation by the control device, and/or as a joint valve device, in particular as a 3/3-way valve. In a proportional valve, the control device can, by presetting a signal level, provide a presettable restriction effect for the working fluid flowing through the respective valve. An electric activation by the control device is preferably provided for the feed line valve and/or for the discharge line valve. Alternatively, the feed line valve and the discharge line valve can be designed as a joint valve device in the manner of a spool valve, in particular a 3/3-way valve.

In a further development of the invention, the feed line is assigned a pressure sensor to which the control device is coupled and which is designed to provide a pressure-dependent supply pressure signal to the control device. With the aid of the supply pressure signal provided by the pressure sensor in the supply line to the control device, a better movement control for the actuator movement can be achieved, for example if the supply pressure for the working fluid changes in the feed line. This taking account of the supply pressure signal is particularly effective if the discharge line valve is exclusively activated in a manner which is dependent on the flow signal, because in this case, the reaction in the flow volume can be delayed owing to the inertia of the actuator if there are any pressure fluctuations in the feed line; this would make a balanced movement control difficult. Accordingly, it is advantageous to have current knowledge of any pressure fluctuations for the supply pressure of the working fluid in the feed line, so that they can be taken into account in the movement control process.

In a further variant of the invention, the actuator port is assigned a pressure sensor which is coupled to the control device and designed to provide a pressure-dependent working pressure signal to the control device. With the aid of the pressure sensor at the actuator port, a pressure signal can be processed in the control device in addition to the flow signal during the discharge of working fluid from the actuator if the actuator controller is assigned to a single-acting actuator, with the result that the actuator movement can be controlled more precisely. In a double-acting actuator design, a pressure sensor can be assigned both to the working chamber which is supplied with the working fluid during the movement of the actuator and, in addition or alternatively, to the working chamber from which working fluid is discharged during the movement of the actuator. By evaluating the pressure signal of the at least one pressure sensor, the movement control of the actuator movement can likewise be improved, in particular when using gaseous working fluids, where the compatibility of the working fluid has a considerable influence on the movement control (closed loop control) of the actuator.

It is advantageous if two actuator ports are provided, to each of which are assigned a feed line with a feed line valve and a discharge line with a discharge line valve, the discharge lines terminating in a joint fluid outlet and the flow sensor being assigned to the fluid outlet. With an actuator controller designed in this way, a movement control for a double-acting actuator can be obtained. In this, each of the actuator ports is assigned to a corresponding working chamber of the double-acting actuator, and owing to the mechanical construction of the actuator, a feed of working fluid to one of the working chambers is accompanied by a simultaneous discharge of working fluid from the other working chamber. In this process, the outflowing working fluid always passes through one of the discharge lines and the associated discharge line valve and then passes through the joint fluid outlet and the flow sensor mounted thereon. The use of such an actuator controller results in a particularly simple construction for a double-acting actuator, because there is no need to assign its own flow sensor to each discharge line valve. Furthermore, with such an actuator controller a feed of working fluid into one of the working chambers of the actuator and a discharge of working fluid from the other working chamber of the actuator can be coordinated with a joint control device in a particularly advantageous way.

According to a second aspect of the invention, the problem of the invention is solved by a method for controlling the movement of an actuator connected to an actuator port of an actuator controller, and the actuator port is connected to a fluid outlet via a discharge line in which a discharge line valve is located, a flow sensor being assigned to the fluid outlet. According to the invention, it is provided that a fluid flow rate from the actuator to the fluid outlet is detected at an at least partial opening of the discharge line through the discharge line valve and an actuator movement, and that a flow-dependent activation of the discharge line valve is performed in order to influence the actuator movement in a manner dependent on a presettable movement profile. For the movement control of the actuator, a flow signal is required, which in turn requires a flow of working fluid through the flow sensor. It is possible that such a flow cannot be detected reliably at the start of the actuator movement, in which case it can be provided that, at the start of an actuator movement, the discharge line valve initially opens the discharge line in a presettable way, in particular only partially, in order to facilitate an actuator movement and a resulting working fluid flow rate. As soon as the flow sensor provides a stable flow signal, the actuator movement can be controlled using the flow signal of the flow sensor and then in accordance with the preset movement profile.

In a further development of the method, it is provided that the movement profile comprises a starting movement from an end position or an intermediate position and/or a travelling movement and/or a deceleration movement towards an end position or an intermediate position for the actuator. The actuator may for example be a double-acting fluidic cylinder in which a working piston with an associated piston rod is movable between a first end position and a second end position. Using the method according to the invention, a starting movement from one of the end positions or from an intermediate position between the end positions can be provided for the working piston. In addition or as an alternative, the movement profile can comprise a travelling movement between the end positions or between an end position and an intermediate position or between an intermediate position and an end position. The movement profile can further comprise a deceleration movement towards an end position or an intermediate position. The movement can optionally be oriented towards a consideration of the acceleration of the actuator or the reaching of a presettable target speed for the actuator or of a combination thereof.

In an advantageous further development of the method, it is provided that during the flow-dependent activation of the discharge line valve assigned to a first actuator port, a flow-dependent activation of a feed line valve in a feed line to a second actuator port is performed, wherein the feed line valve is activated in a manner dependent on a sensor signal level of the flow sensor assigned to the fluid outlet of the first actuator port. By means of the combined activation of the feed line valve for the second actuator port and the discharge line valve for the first actuator port, the actuator movement can be controlled particularly sensitively. In this context, it is advantageous if both the discharge line valve and the feed line valve are actuated by the same control device for a particularly advantageous coordination of the two control operations for the performance of the movement control.

In an advantageous further development of the method, it is provided that a supply pressure signal of a pressure sensor located in the feed line, in particular between the fluid port and the feed line valve or between the feed line valve and the actuator port, and coupled to the control device is output for an activation of the feed line valve. The inclusion of the supply pressure signal of the pressure sensor is of particular interest if the working fluid is a compressible, in particular gaseous, working fluid, because owing to the compressibility of the fluid there is no proportionality between the inflow of working fluid into a first working chamber of the actuator and a discharge of working fluid from a second working chamber of the actuator. Accordingly, with the aid of the pressure signal, the movement control for the actuator can be predicted in order to ensure the desired movement control for the actuator movement in accordance with the preset movement profile.

BRIEF DESCRIPTION OF THE DRAWINGS

An advantageous embodiment of the invention is illustrated in the drawing, of which

DETAILED DESCRIPTION OF THE PREFERRED EMBODIMENTS

Figure 1:
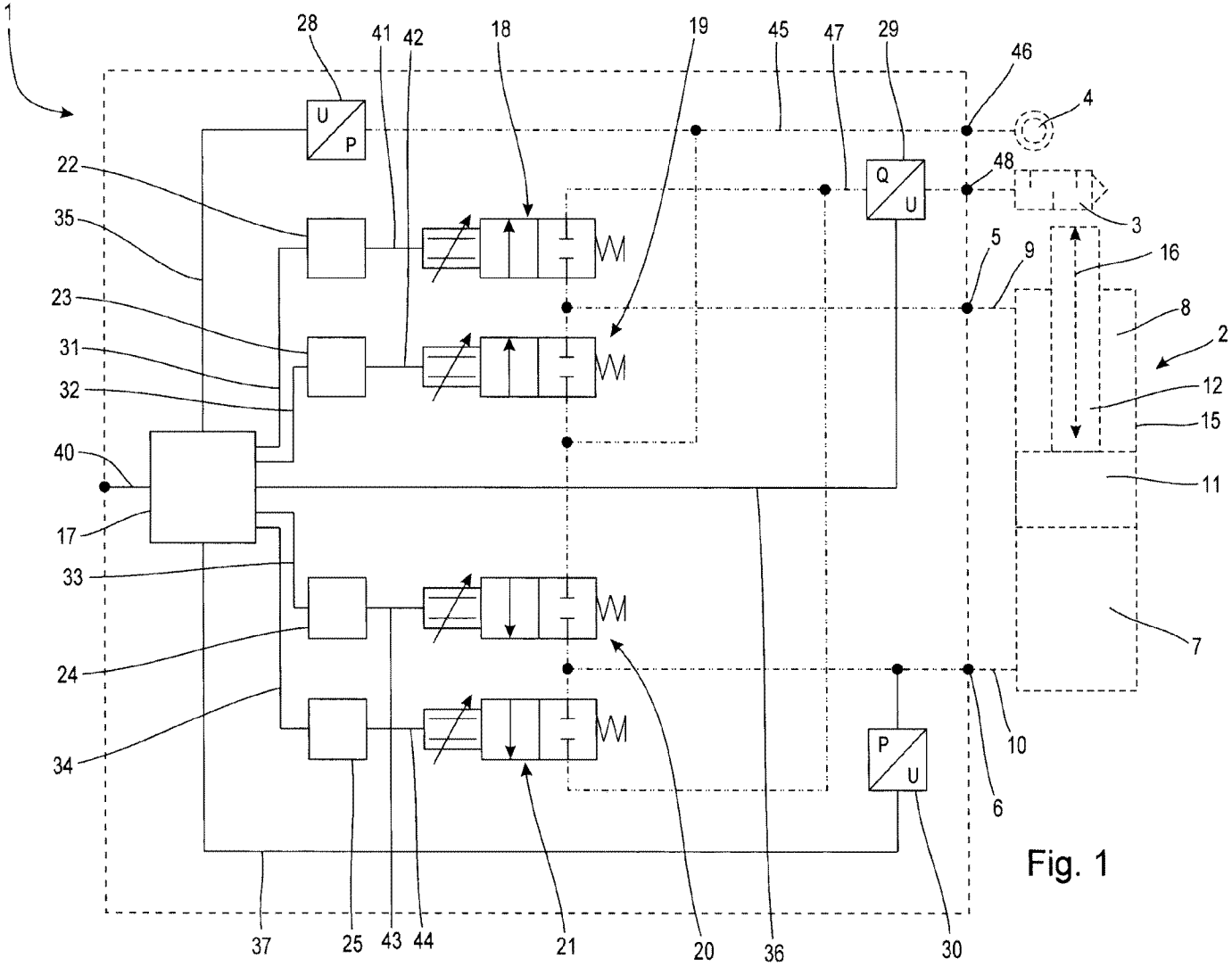
FIG. 1 shows an actuator controller of the operation of a double-acting fluid-operated actuator.

The actuator controller 1 shown in FIG. 1 is provided for the activation of a fluid-operated actuator 2, which is not a part of the actuator controller 1 and is therefore, like a silencer 3 and a fluid source 4, indicated by broken lines in FIG. 1. In the illustrated embodiment, the actuator controller 1 comprises a first actuator port 5 and a second actuator port 6, which are connected by fluid lines 9 and 10 respectively to a first working chamber 7 and a second working chamber 8 of the actuator 2. The working chambers 7, 8 in the actuator 2 are formed in an actuator housing 15 and separated from one another by a displaceable working piston 11 in a size-variable manner, the working piston 11 being assigned a piston rod 12, which passes through the actuator housing 15 and is designed for the transmission of a movement to a machine element not shown in detail. By applying pressure to the first working chamber 7 and/or to the second working chamber 8, a force can be applied to the working piston 11, which is slidably accommodated in the actuator housing 15 while forming a seal. In accordance with a balance of forces for the working piston 11, which results from the pressure conditions for working fluid in the working chambers 7 and 8 and is dependent on the active surfaces of the working piston 11, a force which may, if applicable, result in a movement of the working piston 11 and the piston rod 12 connected thereto is applied to the working piston 11.

The actuator controller 1 of the illustrated embodiment is shown as an assembly, and the components of the actuator controller 1 shown in greater detail below can be implemented both separately and in a combined construction.

The actuator controller 1 comprises a control device 17, several valves 18, 19, 20, 21 as well as activation units 22, 23, 24 and 25 assigned to the valves 18 to 21 and several sensors 28, 29 and 30.

The control device 17 may, for example, be designed as a microcontroller or microprocessor and is electrically connected to the activation units 22 to 25 and the sensors 28, 29 and 30 respectively by control lines 31, 32, 33, 34 and sensor lines 35, 36, 37. The control device 17 of the illustrated embodiment is further assigned a communication line 40, which is provided as a communication link to a higher-order control unit, in particular a programmable logic controller, or to other actuator controllers, and which is, in the illustrated embodiment, provided for data exchange in accordance with a presettable communication protocol, in particular a bus communication protocol.

The valves 18 to 21 of the illustrated embodiment are designed as 2/2-way valves with piezoelectric activation and can be operated as proportional valves. Owing to the piezoelectric activation, the operation of the valves 18 to 21 requires the provision of a high-voltage signal, which is provided by the associated activation units 22 to 25 via the associated activation lines 41 to 44. Each of the valves 18 to 21 can therefore be adjusted freely between a closed position and an open position in response to a control signal provided by the control device 17 for the respective activation unit 22 to 25.

In the illustrated embodiment, it is provided that each of the valves 19 and 20 is in fluidically communicating connection to a supply line 45, the supply line 45 starting at a supply port 46, to which the fluid source 4 can be connected. There is further provided a fluidically communicating connection between the supply line 45 and the sensor 28 designed as a pressure sensor, which converts a pressure level prevailing in the supply line 45 into an electric supply pressure signal which is made available to the control device 17 via the sensor line 35. Accordingly, the supply pressure made available by the fluid source 4 to the supply line 45 and the downstream valves 19, 20 can be detected with the aid of the sensor 28. Furthermore, the valves 19 and 20 are connected to one of the actuator ports 5 and 6 respectively on the outlet side, so that, if the respective valve 19, 20 is opened, a fluidically communicating connection can be established between the supply line 45 and the respective actuator port 5 or 6, in order to allow a feed of working fluid into the respective working chamber 7, 8.

Each of the valves 18 and 21 is connected to the respective actuator port 5 or 6 on the inlet side and to a discharge line 47, which passes through the sensor 29 designed as a flow sensor and terminates at a fluid outlet 48, on the outlet side. In this way, the valves 18 and 21 facilitate a fluid discharge from the associated working chambers 7, 8 of the actuator 2.

For a movement of the working piston 11 along the movement path 16, the following procedure can be provided by way of example: Depending on the desired movement direction for the actuator 2, pressurised working fluid is made available at the actuator port 5 or at the actuator port 6 for the respective working chamber 7, 8 of the actuator 2 by the respective valve 19 or 20 establishing a fluidically communicating connection between the supply line 45 and the respective actuator port 5 or 6.

The following considerations are based on the assumption that an extension movement of the piston rod 12 is to be provided. Accordingly, pressurised working fluid is applied to the working chamber 7, so that the working chamber 8 becomes smaller, accompanied by a fluid discharge from the working chamber 8 via the actuator port 6, owing to the resulting movement of the working piston 11. For applying pressure to the working chamber 7, the valve 19, which is also described as feed line valve, is moved from the illustrated closed position into an open position not shown in the drawing. This results in a fluidically communicating connection between the fluid source 4, the supply line 45 and the actuator port 5, allowing pressurised fluid to flow into the working chamber 7. Owing to the force acting on the working piston 11 in this process, the latter is displaced towards the working chamber 8, thereby reducing its volume. It is further provided that the working fluid in the working chamber 8 is ducted via the fluid line 10, the actuator port 6, the valve 21, which is also described as discharge line valve, and the discharge line 47 to the sensor 29 designed as a flow sensor and to the fluid outlet 48, where it can be discharged into the environment or into a storage tank after flowing through the silencer 3. Depending on the flow rate of the working fluid flowing through the sensor 29, the latter provides an electric flow signal to the control device 17 via the sensor line 36. In the control device 17, the actual flow rate of the working fluid to the fluid outlet is then calculated in a manner dependent on a signal level of the flow signal provided, and on the basis of this calculation, the acceleration and/or speed of the working piston 11 and the piston rod 12 joined thereto is/are determined. In the control device 17 there is preferably stored a movement profile, in particular an acceleration or speed profile, for the movement of the working piston 11, which can be compared to the actual acceleration and/or speed of the working piston as determined using the flow signal. If the stored movement profile deviates from the detected movement profile, the control device 17 can optionally provide a restriction of the working fluid leaving the working chamber 8 and/or a restriction of the working fluid fed into the working chamber 7 by means of a suitable activation of the valve 19.

Figure 2:
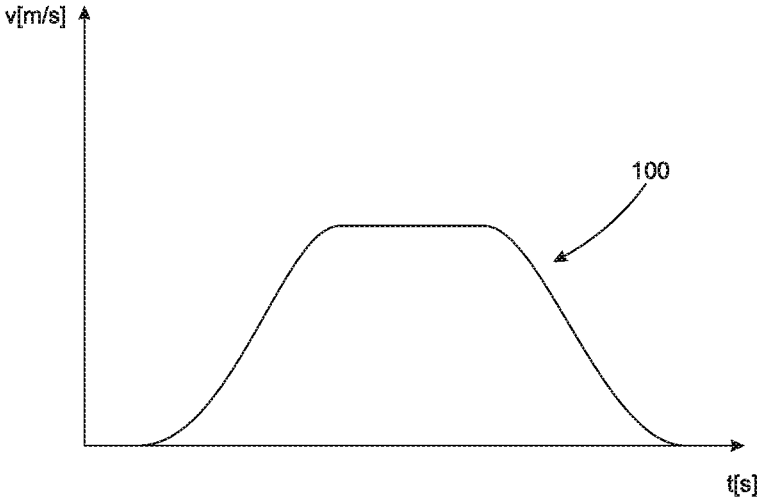
FIG. 2 shows a movement profile for the fluid-operated actuator.

The movement profile according to FIG. 2 shows a speed profile 100 for the fluid-operated actuator 2 comprising a starting movement from a first end position, a travelling movement and a deceleration movement towards a second end position.

The actual movement profile for the working piston 11 can be matched better to a stored movement profile by processing at least one pressure signal of the sensors 28 and 30 designed as pressure sensors. The sensor 28 detects the supply pressure in the supply line 45 and provides a measurement result in the form of an electric signal to the control device 17. The sensor 30, which is likewise designed as a pressure sensor, detects a working pressure at the actuator port 6 and provides a measurement result in the form of an electric working pressure signal to the control device 17. A use of at least one pressure sensor 28 and/or 30 is of particular interest if the working fluid is a compressible fluid, in particular a gas and preferably compressed air, because an inclusion of the supply pressure and/or the working pressure facilitates an improved movement control. In an embodiment of the actuator controller which is not shown in the drawing, a working pressure sensor connected to the control device is assigned to the second actuator port as well.

For a retraction movement of the piston rod 12 and the working piston 11 coupled thereto, the valves 20 and 18 are activated in a reversal of the above description, so that pressurised fluid can be applied to the actuator port 6 for the working chamber 8, while working fluid can flow from the working chamber 7 via the actuator port 5 through the valve 18 to the discharge line 47 and, after passing through the sensor 29, to the fluid outlet 48. This movement can likewise be controlled for the actuator 2, using the flow signal of the flow sensor.

The invention claimed is:

1. A method for controlling the movement of an actuator connected to a first actuator port of an actuator controller, wherein the first actuator port is connected to a fluid outlet via a discharge line in which a discharge line valve is located, a flow sensor being assigned to the fluid outlet, the method comprising:

detecting a fluid flow rate from the actuator to the fluid outlet at an at least partial opening of the discharge line through the discharge line valve during a movement of the actuator;

performing a flow-dependent activation of the discharge line valve in order to influence the movement of the actuator in a manner dependent on a presettable movement profile stored in a control device of the actuator controller, wherein the movement profile comprises an acceleration profile or a speed profile;

performing a flow-dependent activation of a feed line valve in a feed line to a second actuator port during the flow-dependent activation of the discharge line valve assigned to the first actuator port;

activating the feed line valve in a manner dependent on a sensor signal level of the flow sensor assigned to the fluid outlet of the first actuator port; and activating the feed line valve by taking into account a supply pressure signal of a pressure sensor located in the feed line and coupled to the control device.

2. The method according to claim 1, wherein the pressure sensor is located in the feed line between a fluid supply port and the feed line valve or in the feed line between the feed line valve and the second actuator port.

* * * * *